US006092263A

United States Patent [19]

Boue et al.

[11] Patent Number: 6,092,263

[45] Date of Patent: Jul. 25, 2000

[54] HINGE WITH ELASTIC RING RETURN SYSTEM

[75] Inventors: Eric Boue, Ozoir la Ferriere; Marcel Bourgain, Paris, both of France

[73] Assignee: Adler S.A., Moussy le Neuf, France

[21] Appl. No.: 09/180,041

[22] PCT Filed: May 6, 1997

[86] PCT No.: PCT/FR97/00798

§ 371 Date: Oct. 30, 1998

§ 102(e) Date: Oct. 30, 1998

[87] PCT Pub. No.: WO97/43511

PCT Pub. Date: Nov. 20, 1997

[30] Foreign Application Priority Data

May 9, 1996 [FR] France ..... 96 05774

[51] Int. Cl.[7] ..... E05F 1/08

[52] U.S. Cl. ..... 16/286; 16/335; 16/327; 16/296

[58] Field of Search ..... 16/286, 335, 336, 16/327, 334, 296, 303; 4/607, 614, 557; 49/381, 501, 799

[56] References Cited

U.S. PATENT DOCUMENTS

| | | | |
|---|---|---|---|
| 3,212,124 | 10/1965 | MacDonald | 16/327 |
| 3,381,333 | 5/1968 | Jerila | 16/327 |
| 3,691,788 | 9/1972 | Mazziotti | 16/334 |
| 3,837,043 | 9/1974 | Coe . | |
| 3,842,463 | 10/1974 | Wehner . | |
| 4,891,862 | 1/1990 | Holan | 16/334 |
| 5,867,869 | 2/1999 | Garrett et al. | 16/334 |

FOREIGN PATENT DOCUMENTS

| | | |
|---|---|---|
| 0 206 859 | 12/1986 | European Pat. Off. . |
| 3 901 395 | 8/1990 | Germany . |
| 2 254 016 | 9/1993 | Germany . |

*Primary Examiner*—Chuck Y. Mah
*Attorney, Agent, or Firm*—O'Melveny & Myers LLP

[57] ABSTRACT

The invention features a hinge or coupling two panels (P1, P2), one of which at least opens rotatably about an axis (X) parallel to the planes of the said panels, comprising a mobile fixing element (1) on the opening panel, a fixing element on the other panel and linking means (3) between the fixing elements co-operating with elastic return means of the panel opening to at least a stable angular equilibrium position, characterized in that the said return means consists of a ring (4) located in a cavity (10) of the mobile fixing element (1) and capable of being elastically deformed by the pressing action of a cam (30) rotating about a central shaft (5) parallel to the planes of the panels, being carried by the linking means (3).

14 Claims, 6 Drawing Sheets

Figure 1B:
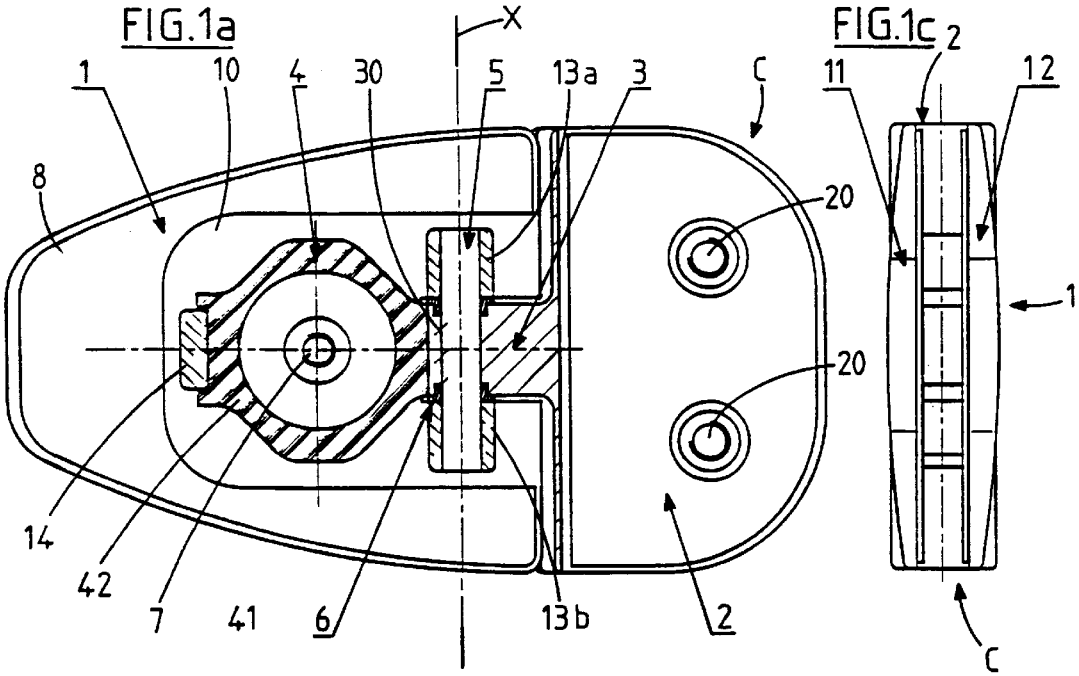
Figure 1B:
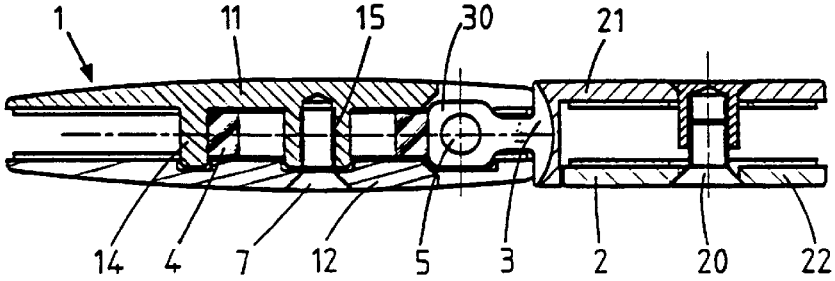

FIG.3a
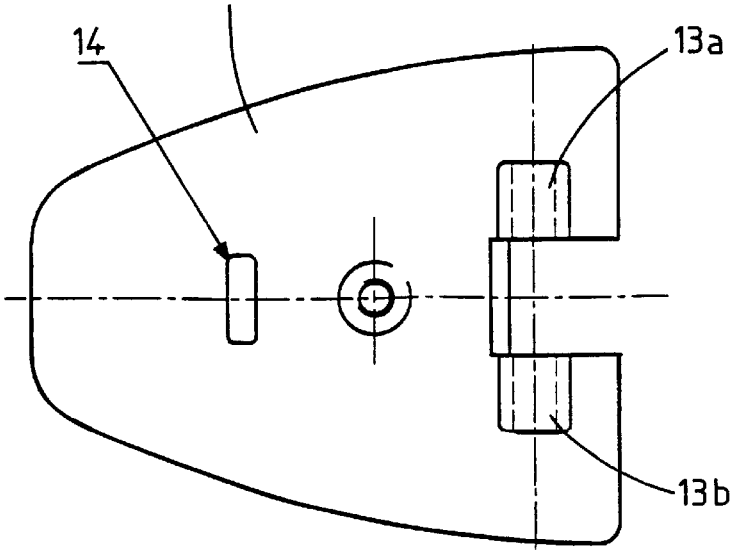
FIG.3b
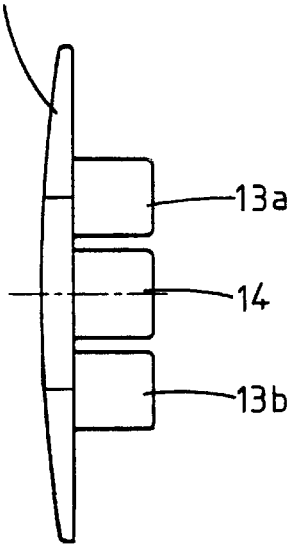
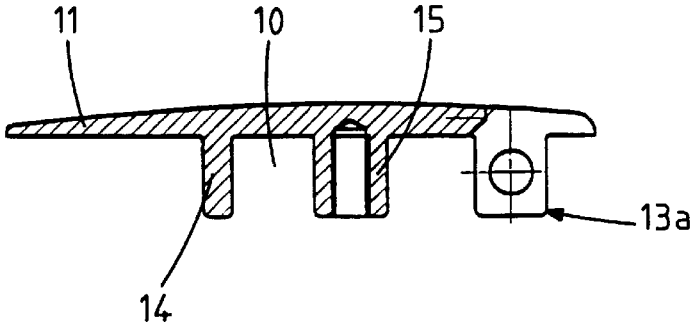
FIG.3c

FIG.4b
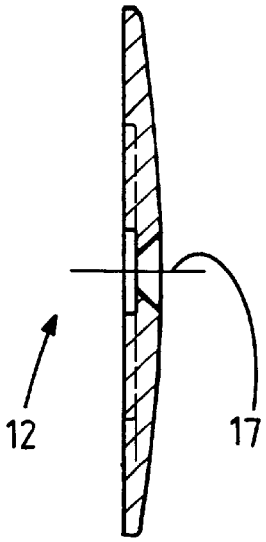
FIG.4a
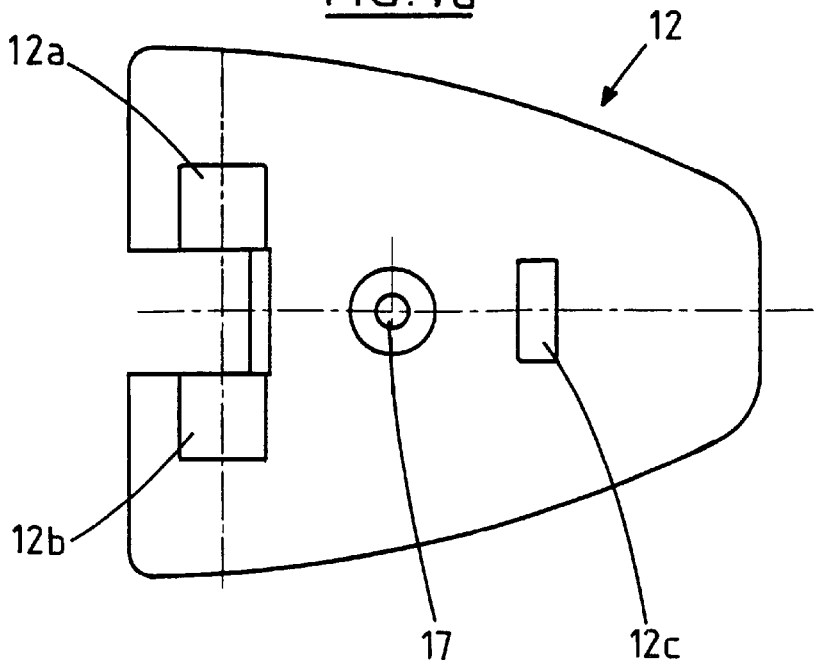
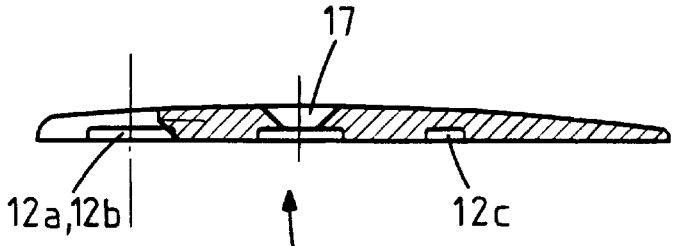
FIG.4c

HINGE WITH ELASTIC RING RETURN SYSTEM

The present invention relates to a hinge for coupling two panels with respect to each other.

More particularly, the invention is applied to panels of which at least one opens rotatably about an axis parallel to the planes of said panels.

Known hinges generally comprise a first fixing element on the mobile panel, a second fixing element on the other fixed or mobile panel and linking means between said fixing elements, cooperating with elastic return means of the panel mobile towards at least a stable angular equilibrium position.

In this type of hinge, the return means are constituted by springs or pistons which are complex, fragile parts which sometimes poorly withstand the repetitive efforts.

Moreover, these hinges necessitate lubrication (oils, greases . . . ) which may be a source of pollution.

In addition, their use is unsuitable, even impossible, in certain applications where the surrounding medium is aggressive or is, for example, capable of generating phenomena of corrosion.

It is an object of the present invention to solve the technical problems mentioned above, or at least to attenuate them.

This object is attained according to the invention by means of a hinge for coupling two panels, of which at least one opens rotatably about an axis parallel to the planes of said panels, of the type comprising a mobile fixing element on the opening panel, a fixing element on the other panel and linking means between the fixing elements cooperating with elastic return means of the panel opening to at least a stable angular equilibrium position, characterized in that said return means consist of a removable ring located in a cavity of the mobile fixing element and capable of being elastically deformed by the pressing action of a cam rotating about a central shaft parallel to the planes of the panels, being carried by the linking means.

According to an advantageous characteristic, said cam is formed from the prismatic end of the linking means ensuring, during rotation of the panel, by its edges, on the one hand, the elastic compression of the ring and, by its lateral faces, on the other hand, the stop and hold of said panel in as many angular equilibrium positions.

According to a particular embodiment, the prismatic end of the linking means comprises three lateral faces connected at 90° by curvilinear edges.

According to another characteristic, said ring comprises lateral ears intended to immobilize it between said cam, on the one hand, and a stop fast with the mobile fixing element, on the other hand.

According to yet another characteristic, said cam is retained in contact with the ring between two recessed cylinders, fast with the mobile fixing element and receiving, on either side of said cam, the ends of the central shaft.

According to another embodiment, the first mobile fixing element is constituted by a stirrup element intended to be assembled with a substantially parallel flange so as to imprison, on the one hand, in the central space, both said ring and said cam and to ensure, on the other hand, the tightening of said element on the periphery of a notch made on the edge of said opening panel.

The central space defined between the stirrup element and the flange of the mobile fixing element is preferably occupied by a shim surrounding the cavity for housing the ring.

Moreover, the stirrup element is provided to be assembled with the flange by means of a screw intended to be anchored in a bush forming spacer member fast with the stirrup element or the flange and which projects in the cavity at the centre of the ring.

According to other characteristics, said cam comprises an inner conduit traversed by the central shaft, arranging a degree of freedom in rotation.

Furthermore, said linking means are fast, on the side opposite the cam, with an element for fixing to a fixed panel.

According to a variant, said linking means are joined to said fixing element via a 90° bend.

In another particular embodiment, said linking means bear a cam at each end and the mobile fixing elements are equipped with elastically deformable rings so that the two panels open by rotation.

According to a first variant of the above embodiment, the linking means are rectilinear in order to allow a 360° clearance of the panels.

According to another variant, the linking means are profiled so as to define between the two end cams an angle included between 90° and 180° as a function of the relative orientation of the panels.

According to yet another embodiment, said linking means are joined at their end opposite the cam, to a plate for fixation on a mural wall.

Another object of the invention resides in the specific use of the above hinge in order to couple glass panels.

The hinge of the invention allows a supple and adjustable clearance of the panels up to 360°, by adapting the linking means and the fixing elements to each situation. In addition, it is applied to panels of different thicknesses and of diverse natures.

The hinge of the invention may be made totally of plastics material, which eliminates any problem of corrosion.

In addition, the simplicity of this hinge, particularly with the removable ring, allows easy and rapid assembly as well as easy maintenance.

Moreover, the hinge of the invention is always clean, as it does not require any lubrication.

Furthermore, it may offer the panels several intermediate equilibrium positions, which makes it possible to decompose the movements of the panels and limits, in particular for glass panels, the risks of violent shocks at the end of stroke which may provoke breaks.

The invention will be more readily understood on reading the following description accompanied by the drawings, in which:

FIGS. 1*a* and 1*b* show views in partial section, respectively front and plan, of a first embodiment of the invention.

FIG. 1*c* shows a side view of the embodiment of FIGS. 1*a* and I*b*.

Figure 2A:
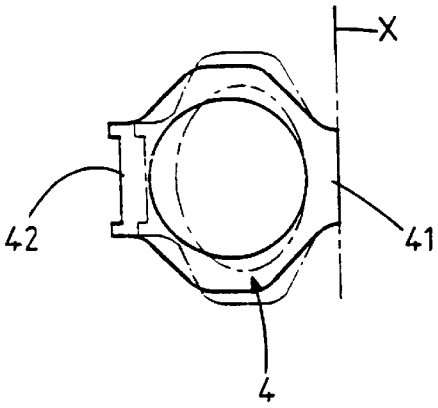
Figure 2B:
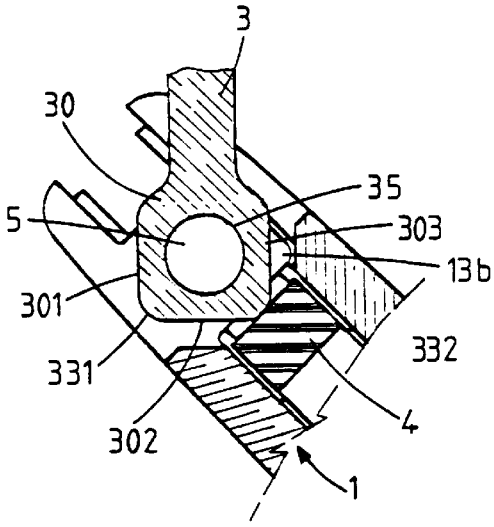

FIGS. 2*a* and 2*b* respectively show a front view of the ring of the hinge and a plan view in partial section of the hinge in operation.

Figure 2C:
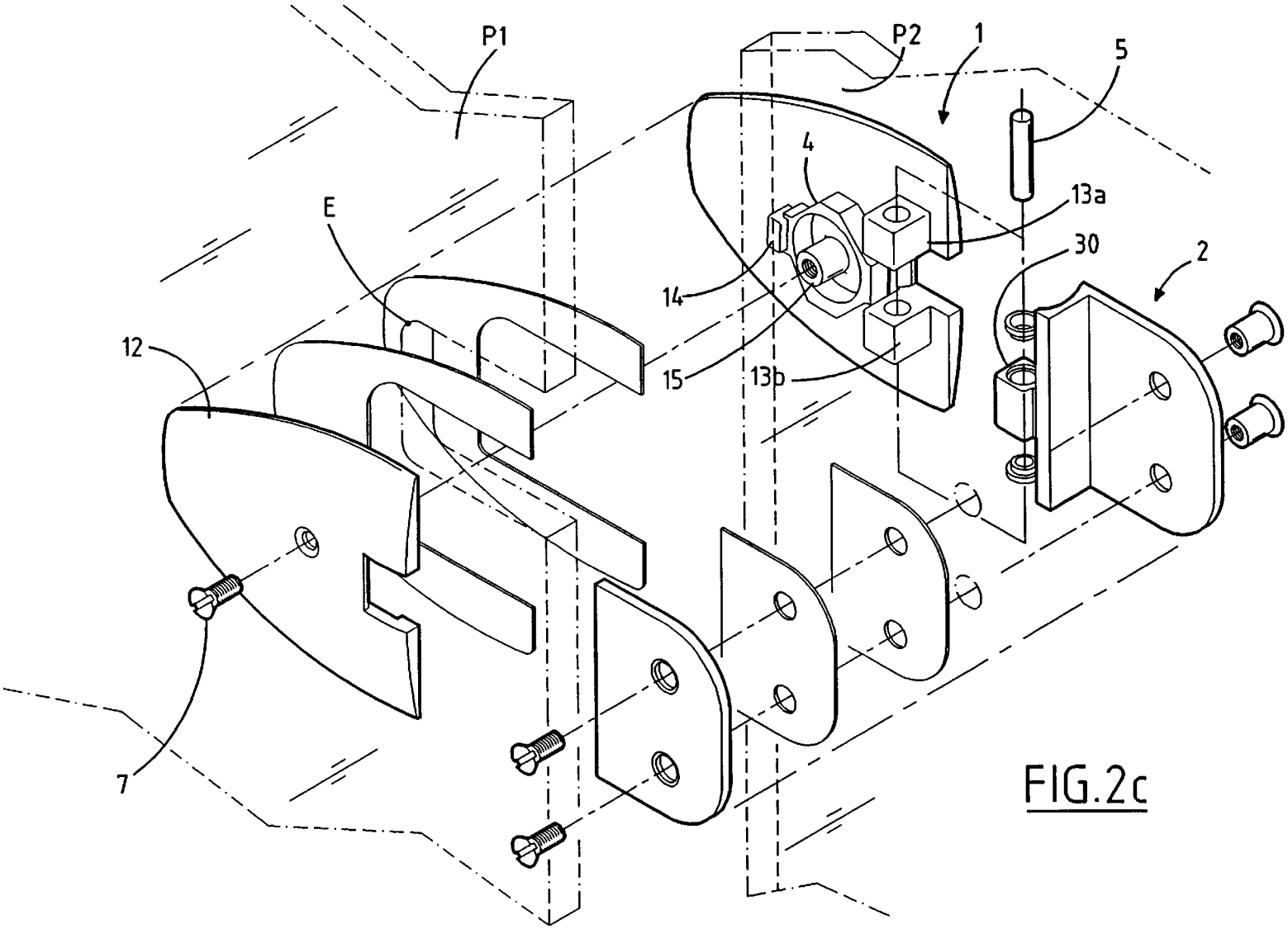

FIG. 2*c* shows an overall view in perspective of two panels coupled by means of the hinge of the invention.

FIGS. 3*a*, 3*b* and 3*c* show views of the stirrup element of the first fixing element, respectively in front, side and plan view in partial section.

FIGS. 4*a*, 4*b*, 4*c* show views of the flange of the first fixing element, respectively in front, side and plan view in partial section.

Figure 5A:
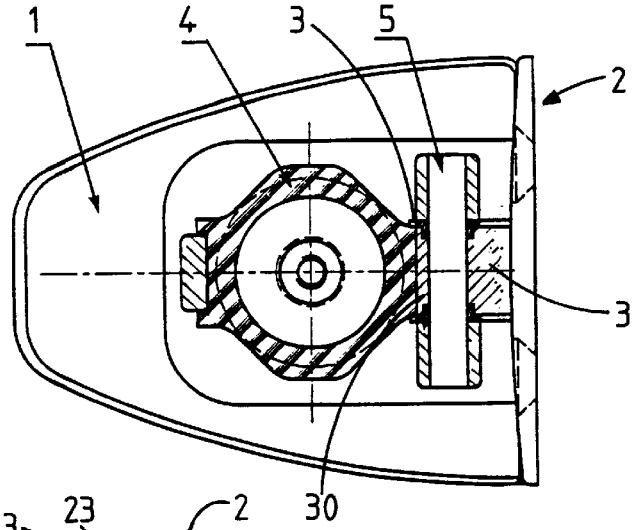
Figure 5B:
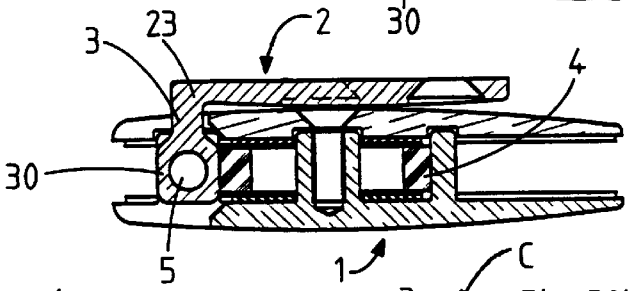

FIGS. 5*a* and 5*b* show views in partial section, respectively front and plan, of a second embodiment of the invention.

Figure 6A:
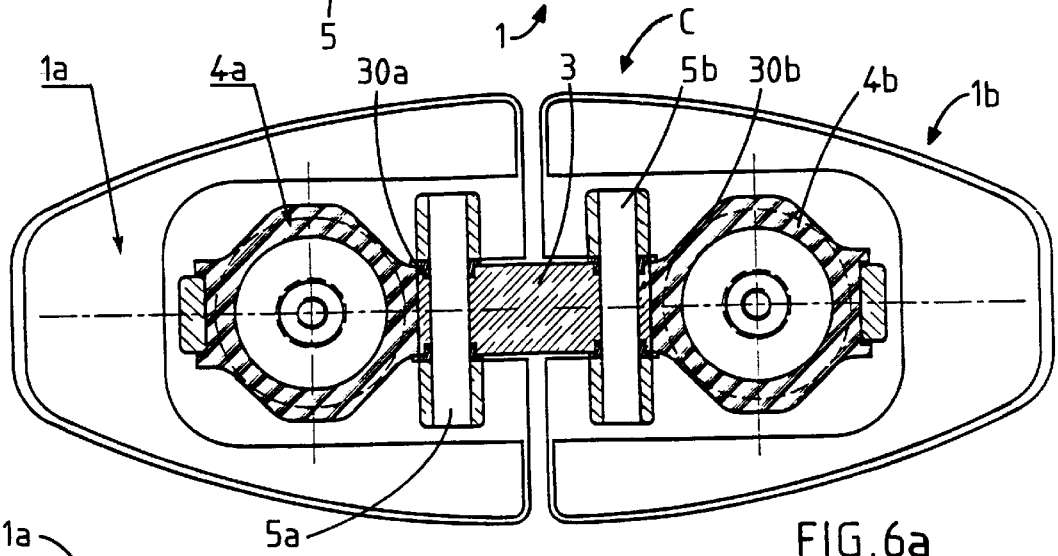
Figure 6B:
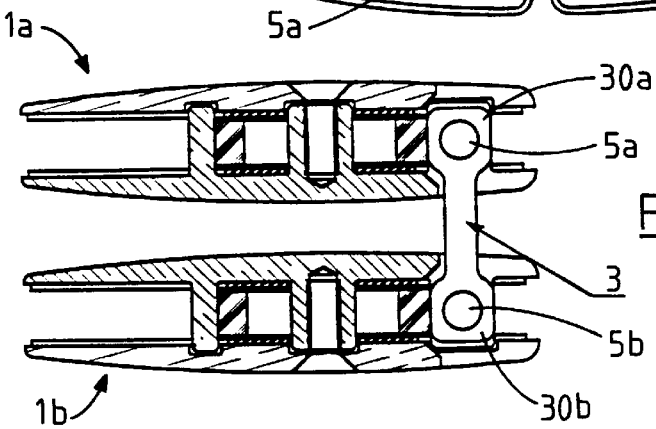

FIGS. 6*a* and 6*b* show views in partial section, respectively front and plan, of a third embodiment of the invention.

Figure 7A:
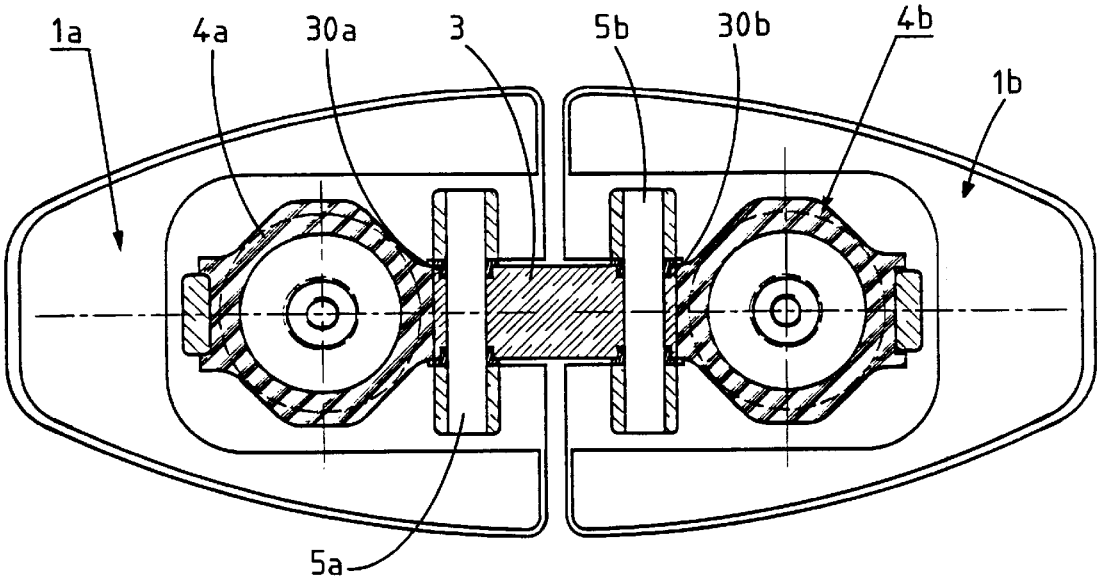
Figure 7B:
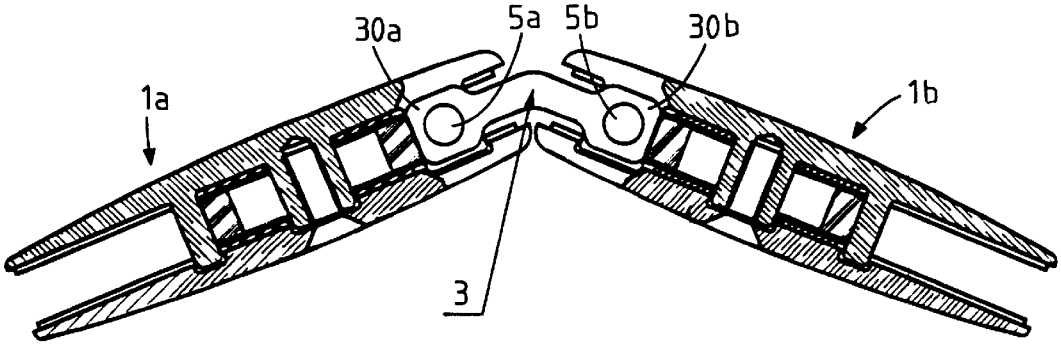

FIGS. 7*a* and 7*b* show views in partial section, respectively front and plan, of a fourth embodiment of the invention.

As shown in FIG. 2*c*, the hinge C of the invention is intended to couple two panels P1, P2 of any dimensions and shapes, of which at least one, P1, opens rotatably about an axis X parallel to the plans of said panels.

Prior to assembling the hinge C, a notch E is made on the lateral edge of the or each opening panel.

The notch E is intended to receive the mobile fixing element 1, i.e. the element for fixing the hinge C on the opening panel P1, as described hereinafter with reference to FIGS. 3*a* to 4*c*.

Of course, articulation of the panels P1, P2 is preferably ensured by a plurality of hinges C mounted at a distance on the lateral edges of the panels.

In the embodiment of FIGS. 1*a*, 1*b* and 1*c*, the hinge C comprises a mobile fixing element 1 on the opening panel P1, a fixing element 2 on the fixed panel P2 which may also be a wall or mural partition (FIGS. 5*a*, 5*b*) and a linking means 3 between the element 1, 2. The linking means 3 cooperate with means for elastically returning the opening panel P1 towards at least one stable angular equilibrium position.

According to the invention, the return means are constituted by a removable ring 4 housed in a cavity 10 in the mobile fixing element 1.

The ring 4 is capable of being elastically deformed, as shown in broken lines in FIG. 2*a*, by the pressing action of a cam 30 rotating about a central shaft 5 disposed along axis X, parallel to the planes of the panels P1, P2, being carried by the linking means 3.

If necessary, the dynamic link between the cam 30 and the shaft 5 is ensured by bearings 6. The ring 4 comprises lateral ears 41, 42 intended to immobilize it between the cam 30, on the one hand, and a stop 14, fast with the mobile fixing element 1, on the other hand.

As appears in FIGS. 1*a* and 3*a*, the cam 30 is retained in contact with the ring 4, between two recessed cylinders 13*a*, 13*b* fast with element 1 and receiving, on either side of the cam 30, the ends of the central shaft 5.

The cam 30 is formed by the prismatic end of the linking means 3 which here comprises, in the embodiments shown, and in particular in FIG. 2*b* in detail, three lateral faces 301, 302, 303.

The three lateral faces 301, 302, 303 ensure the stop and hold of the opening panel P1 in as many angular positions of equilibrium. In these positions, there is always a contact between one of the lateral faces 301, 302 or 303 of the cam 30 and the ear 41 of the ring 4. Similarly, the recessed cylinders 13*a*, 13*b* have a section identical to that of cam 30.

The lateral faces 301, 302, 303 join at 90° by edges of which the sharp angle has been eliminated to form a curvilinear profile which is non-aggressive towards the ring 4.

In the embodiment shown, the cam 30 possesses two edges 331, 332 which respectively ensure elastic compression of the ring 4 by pressing on its ear 41, upon rotation in one direction or in the other.

This compression is accompanied, due to the presence of the stop 14, by a vertical extension along axis X of the ring 4 (cf. FIG. 2*a*). The cam 30 comprises an inner conduit 35 traversed by the central shaft 5, making one degree of freedom in rotation. Furthermore, the linking means 3 are fast, on the side opposite cam 30, with the fixing element 2 which is here formed by a clip whose branches 21, 22 are intended to embrace the lateral edge of the fixed panel P2. The clip 2 is provided with orifices 20 for screws.

The mobile fixing element 1 on the opening panel P1 is constituted by a stirrup element 11 intended to be assembled with a substantially parallel flange 12 so as to imprison in the central space both the ring 4 and the cam 30.

Furthermore, such assembly ensures tightening of the mobile element 1 on the periphery of the notch E of the opening panel P1, by means of a screw 7 (FIG. 1*b*).

The screw 7 is intended to be anchored in a bush 15 forming spacer member which here is fast with the stirrup 11 (cf. FIG. 3*c*) or in a variant (not shown) of the flange 12 and which projects at the centre of the ring 4 in the cavity 10 of the fixing element 1.

The central space defined between the stirrup element 11 and the flange 12 is occupied around the cavity 10 for housing the ring 4 by a shim 8 preferably made of a compressible material such as cork.

The flange 12 shown in FIGS. 4*a* to 4*c* is constituted by a symmetrical plate of the outer wall of the stirrup element 11 pierced with a central orifice 17 for assembling the screw 7.

The inner face of the flange 12 comprises cavities 12*a*, 12*b* disposed opposite the recessed cylinders 13*a*, 13*b* during assembly with the stirrup element 11.

This inner face also comprises a cavity 12*c* intended to be placed opposite the stop 14 and a central cavity 12*d* intended to receive the end of the bush 15.

This arrangement ensures the support of the cylinders 13*a*, 13*b*, the stop 14 and the bush 15 of which the projecting ends are respectively received in cavities 12*a*, 12*b*, 12*c*, while reducing the space between the strirrup element 11 and the flange 12.

In the embodiment of FIGS. 5*a* and 5*b*, the linking means 3 are likewise fast, on the side opposite the cam 30, with an element 2 for fixing to a fixed panel.

However, the fixed panel is, here, a mural wall (not shown) and element 2 is in that case constituted by a plate pierced with two or three orifices 20 intended to receive screws for anchoring in the wall.

The linking means 3 are here joined to the fixing plate 2 via a 90° bend 23 (FIG. 5*b*).

In the embodiment of FIGS. 6*a* and 6*b*, the hinge C is intended to couple two panels opening by rotation (not shown) of the type of the panel P1 described hereinbefore.

Hinge C is therefore provided with two symmetrical mobile elements 1*a*, 1*b* for fixing on the opening panels.

The linking means 3 bear a cam 30*a*, 30*b* at each of its ends and the mobile elements 1*a*, 1*b* are each equipped with an elastically deformable ring 4*a*, 4*b*. The connecting member 3 here is rectilinear to allow a 360° clearance of the panels. The structure of hinge C is identical on each opening panel to the structure described with reference to the previous Figures.

In the embodiment of FIGS. 7*a* and 7*b*, the two panels articulated by hinge C are likewise opening, as in the embodiment of FIGS. 6*a* and 6*b*. However, here, the linking means 3 are profiled so as to define between the two cams 30*a*, 30*b* an angle included between 90° and 180° as a function of the relative orientation of the panels, shown in FIG. 7*b* at 135°.

What is claimed is:

1. A hinge for use in coupling first and second panels of which at least said first panel is movable by rotation about an axis parallel to respective planar surfaces of said first and second panels, comprising:

a first fixing element adapted to engage the first panel, said first fixing element comprising a removable ring disposed in a cavity thereof and a central shaft disposed parallel to the planar surfaces;

a second fixing element adapted to engage the second panel and having a link extending therefrom, said link further having a cam defined by a prismatic end thereof having plural surfaces, said link being rotatable about said central shaft with said cam thereby disposed in movable contact with a face of said ring;

wherein, plural angular equilibrium positions of said first and second fixing elements are defined by contact between said face of said ring and corresponding surfaces of said cam, and relative movement of said first and second fixing elements between said plural equilibrium positions is encouraged by elastic deformation of said ring by pressing action of at least one intersection of said surfaces of said cam against said ring.

2. The hinge according to claim 1, wherein said plural surfaces further comprise three lateral surfaces of said cam respectively connected at approximately 90° angles by curvilinear edges.

3. The hinge according to claim 1, wherein said ring further comprises lateral ears adapted to preclude lateral movement of said ring.

4. The hinge according to claim 1, wherein said first fixing element further comprises two recessed cylinders adapted to receive respective ends of said central shaft, said cam being retained in contact with said ring between two recessed cylinders.

5. The hinge according to claim 1, wherein said first fixing element further comprises a stirrup element and a substantially parallel flange adapted to enclose said ring and said cam therebetween, and thereby permit engagement with a periphery of a notch provided on an edge of said first panel.

6. The hinge according to claim 5, wherein a central space defined between said stirrup and said flange is occupied by a shim surrounding said cavity for housing the ring.

7. The hinge according to claim 6, wherein said stirrup is coupled to said flange by a screw projecting through the cavity at a center of said ring.

8. The hinge according to claim 1, wherein said cam comprises an inner conduit traversed by said central shaft, thereby providing a degree of freedom in rotation of said cam.

9. The hinge according to claim 1, wherein said link is fixedly coupled to said second fixing element.

10. The hinge according to claim 9, wherein said link is fixedly coupled to said second fixing element via a 90° bend.

11. The hinge according to claim 1, wherein said link further comprises a second cam at a second end thereof, said second fixing element further comprising a second removable ring in movable contact with said second cam.

12. The hinge according to claim 11, wherein the link is rectilinear to allow a 360° clearance of the first and second panels.

13. The hinge according to claim 12, wherein the link further comprises a profile so as to define between respective ends thereof an angle between approximately 90° and 180°.

14. The hinge according to claim 1, wherein said second fixing element further comprises a plate adapted for fixing said second fixing end to a wall.

* * * * *